United States Patent [19]

Sakurai et al.

[11] Patent Number: 4,945,887

[45] Date of Patent: Aug. 7, 1990

[54] CRANKCASE VENT SYSTEM

[75] Inventors: Kenichi Sakurai; Kazutoshi Ueda, both of Iwata, Japan

[73] Assignee: Yamaha Hatsudoki Kabushiki Haisha, Iwata, Japan

[21] Appl. No.: 414,680

[22] Filed: Sep. 29, 1989

[30] Foreign Application Priority Data

Sep. 30, 1988 [JP] Japan ..... 63-247760

[51] Int. Cl.[5] ..... F01M 13/00

[52] U.S. Cl. ..... 123/573; 123/41.86

[58] Field of Search ..... 123/41.86, 572, 573, 123/574, 41.31, 41.33, 41.28

[56] References Cited

U.S. PATENT DOCUMENTS

| | | | |
|---|---|---|---|
| 2,771,065 | 11/1956 | Malcolm | 123/41.86 |
| 2,782,775 | 2/1957 | Leach | 123/41.86 |
| 2,821,174 | 1/1958 | Scheiterlein | 123/41.86 |
| 4,790,287 | 12/1988 | Sakurai et al. | 123/41.86 |

*Primary Examiner*—Noah P. Kamen

*Attorney, Agent, or Firm*—Ernest A. Beutler

[57] ABSTRACT

A cooling system and crankcase ventilating system for a V type internal combustion engine wherein the crankcase ventilating system includes a crankcase ventilating chamber that is positioned in the valley of the V of the engine. The cooling system includes a main coolant gallery that extends through the valley of the engine and is disposed between the crankcase ventilating chamber and the crankcase for cooling the crankcase ventilating gases. The main gallery also partially encircles the main oil gallery for cooling the lubricant.

17 Claims, 11 Drawing Sheets

CRANKCASE VENT SYSTEM

BACKGROUND OF THE INVENTION

This invention relates to a crankcase vent system and more particularly to an improved crankcase ventilation system that insures adequate ventilation of the crankcase while also insuring against the removal of lubricant from the crankcase through the ventilating system.

The desirability of providing a flow of ventilating air through the crankcase and certain other internal passages of an internal combustion engine is well known. Recently, the discharge of the ventilating gases from the crankcase is not into the atmosphere but is back into the induction system of the engine so as to reduce the emission of unwanted vapors to the atmosphere.

When the circulating air passes through the crankcase, however, it has a tendency to pick up oil particles which are returning from the engine to the crankcase. These oil particles have been employed to lubricate the engine and are swept up with the crankcase ventilating air. It is, of course, important to insure that the lubricant is separated from the crankcase ventilating gases before it is returned to the atmosphere so as to insure against loss of lubricant and other unfavorable results. However, frequently the flow of crankcase ventilating gases is through areas of the engine that are highly heated and the lubricant particles that are contained in the ventilating air actually may tend to vaporize or reduce in size so as to make their separation difficult.

In one form of crankcase ventilating system normally used with V type engines, the valley between the banks of cylinders is used as a return conduit or passageway for the crankcase ventilating gases. This conduit may extend across all or part of the length of the engine and lies directly above the crankcase. Although the use of this volume for crankcase ventilating purposes is quite desirable, the proximity of the conduit to the highly heated crankcase tends to cause the aforenoted difficulties in connection with separation of the lubricant particles from the air before they are discharged.

It is, therefore, a principal object of this invention to provide an improved crankcase ventilating system for an internal combustion engine.

It is a further object of this invention to provide a crankcase ventilating system for an internal combustion engine wherein the crankcase ventilating gases are cooled before they are discharged to the atmosphere so as to assist in the separation of lubricant from the gases.

It is a further object of this invention to provide an improved arrangement for insuring that the crankcase ventilating gases of an internal combustion engine will not be overheated during their circulation so as to improve the separation of lubrication therefrom.

SUMMARY OF THE INVENTION

This invention is adapted to be embodied in a crankcase ventilating system for an internal combustion engine comprising a cylinder block having a plurality of aligned cylinders. A crankcase is positioned beneath the cylinder block and a crankcase ventilating chamber is formed at least in part by the cylinder block and extends along at least a portion of its length. A crankcase ventilating inlet communicates the crankcase ventilating chamber with the crankcase for receiving ventilating gases therefrom. A crankcase ventilating outlet discharges crankcase ventilating gases from the chamber. A cooling jacket is formed in the cylinder block and has a portion that extends adjacent the crankcase ventilating chamber and separates the crankcase ventilating chamber from the crankcase for cooling the crankcase ventilating gases to recondense vaporized lubricant from the crankcase.

DETAILED DESCRIPTION OF THE PREFERRED EMBODIMENTS

Figure 1:
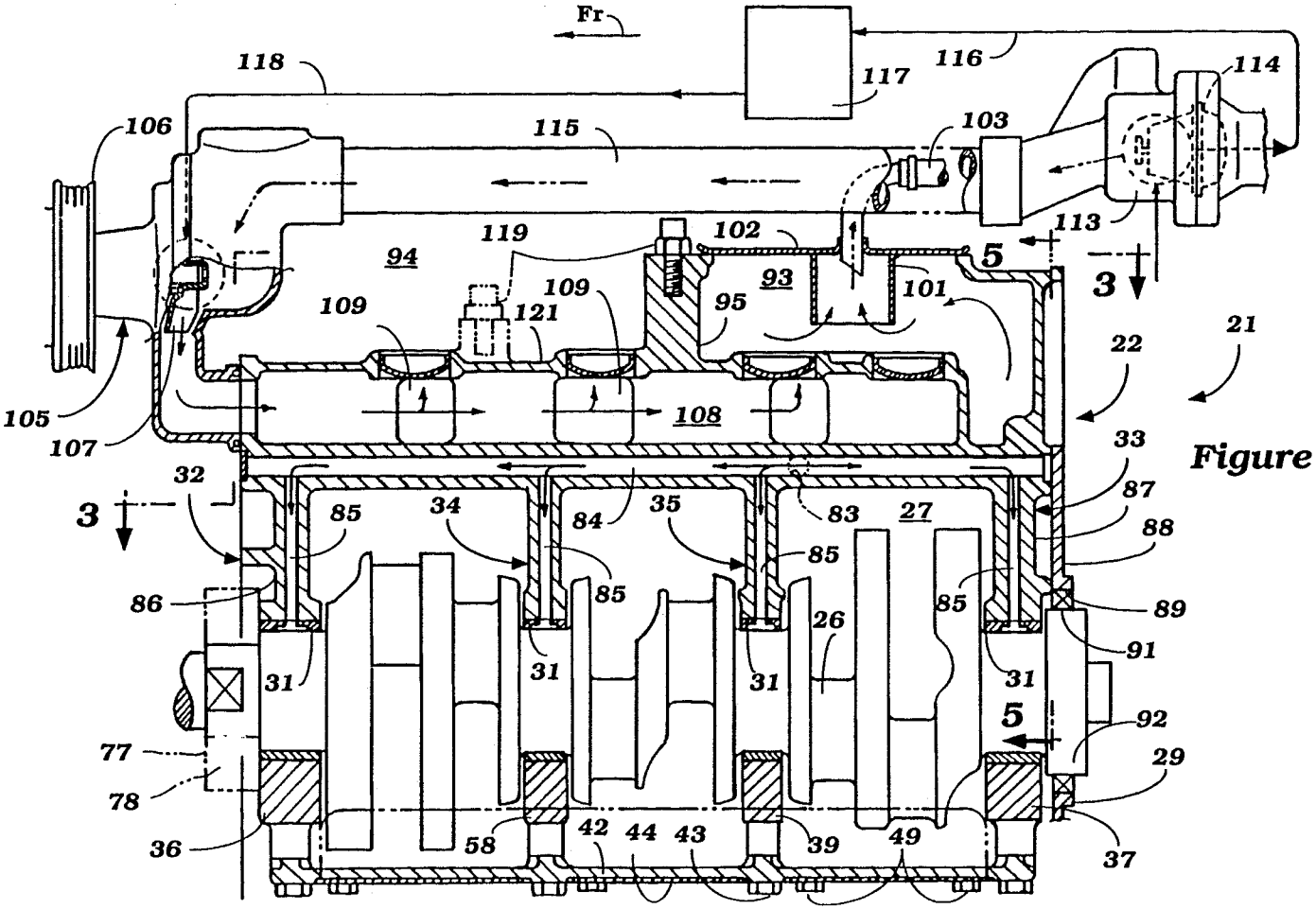
FIG. 1 is a cross-sectional view taken through a V type engine having a crankcase ventilating system constructed in accordance with an embodiment of the invention and is taken generally along the line 1—1 of FIG. 2.

Referring first to the embodiments of FIGS. 1 through 13, an internal combustion engine constructed in accordance with an embodiment of the invention is identified generally by the reference numeral 21. In the illustrated embodiment, the engine 21 is of the automotive type and is designed so as to be positioned transversely in the engine compartment of a front engine, front wheel driven car. Such an installation is only typical of the environments in which the invention can be practiced. Even though the engine is disposed transversely, one end of the engine is identified as the front and the other end is identified as the rear. The front of the engine is identified by the arrow Fr in certain of the figures and as is conventional in transverse engine placement, the left hand side of the engine is considered to be the front side of the engine.

The engine 21 includes a cylinder block, indicated generally by the reference numeral 22 which, in the illustrated embodiment, is of the V6 type. It is to be understood, however, that the invention can be utilized in conjunction with engines having other numbers of cylinders or other cylinder configurations. The invention has particularly utility, however, in connection with V type engines for reasons which will become apparent.

The cylinder block 22 is formed with inclined cylinder banks 23 and 24 that are angularly related to each other and each of which is formed with three cylinder bores 25. The area between the cylinder banks 23 and 24 is generally referred to as the valley and, as will become apparent, the invention deals at least partially with how that valley of the engine is utilized in conjunction with the cooling and crankcase ventilating system.

Figure 3:
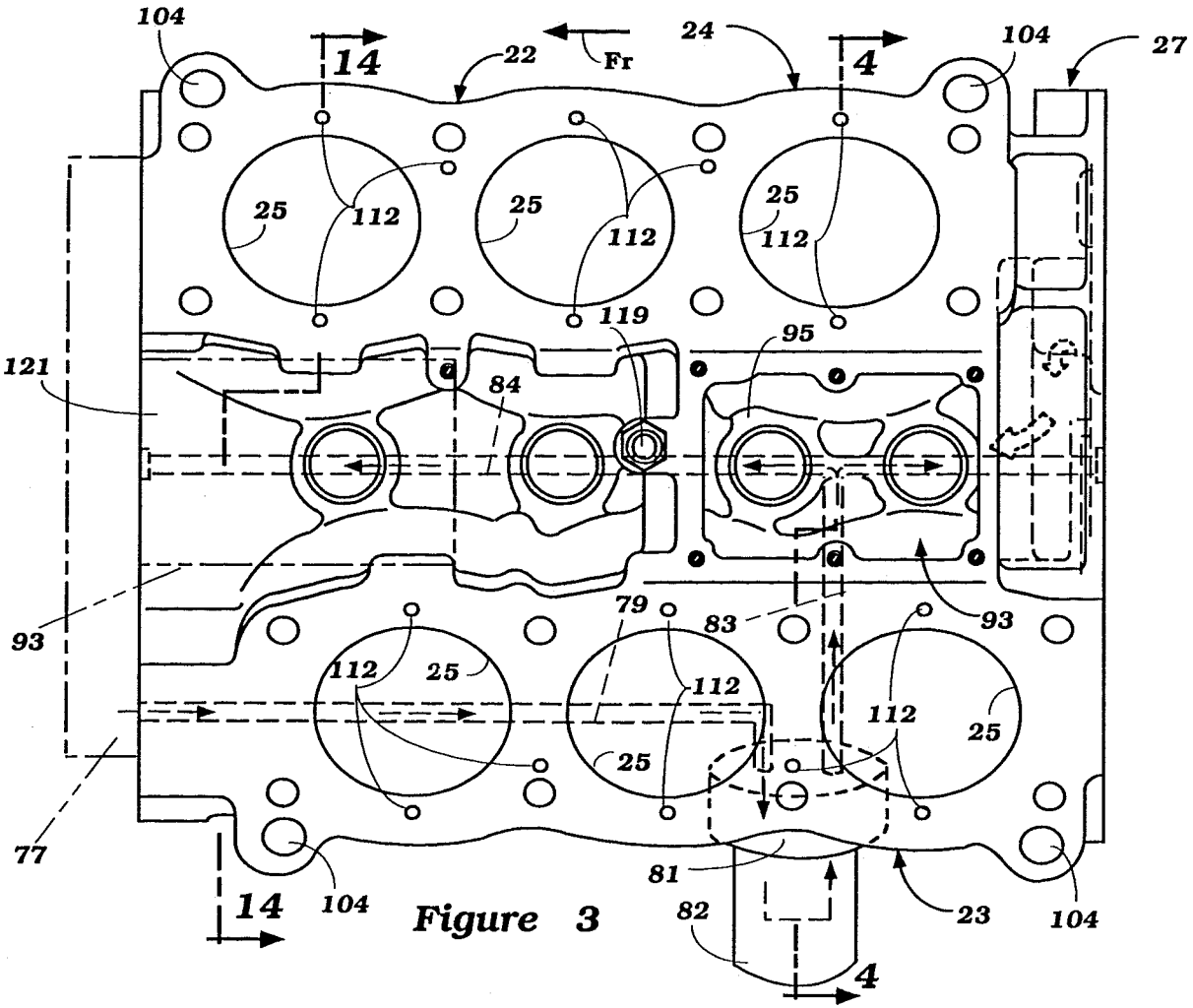
FIG. 3 is a top plan view of the engine with the cylinder heads and intake manifold removed and is taken generally along the line 3—3 of FIG. 1.
Figure 4:
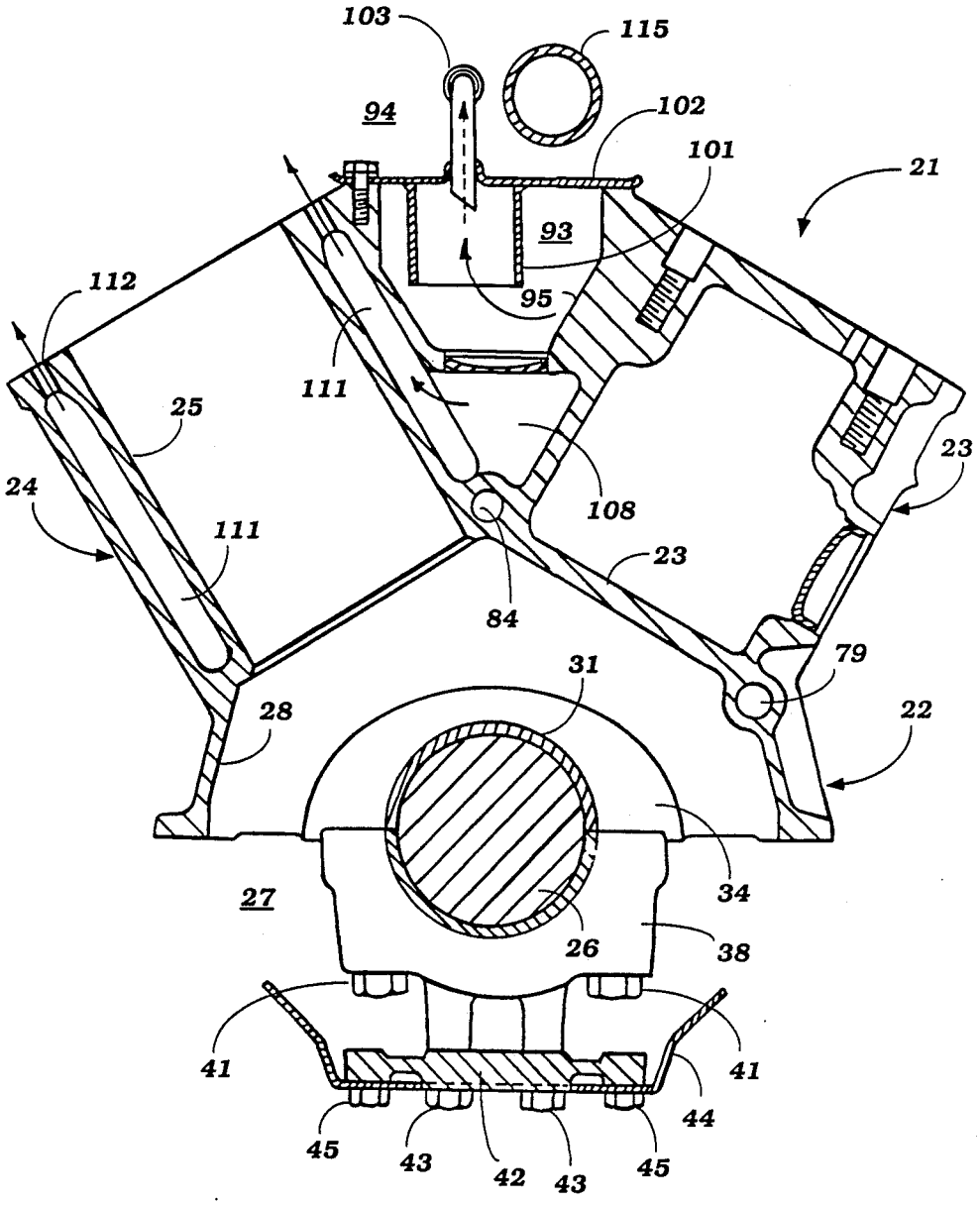
FIG. 4 is a cross-sectional view taken along the line 4—4 of FIG. 3.
Figure 5:
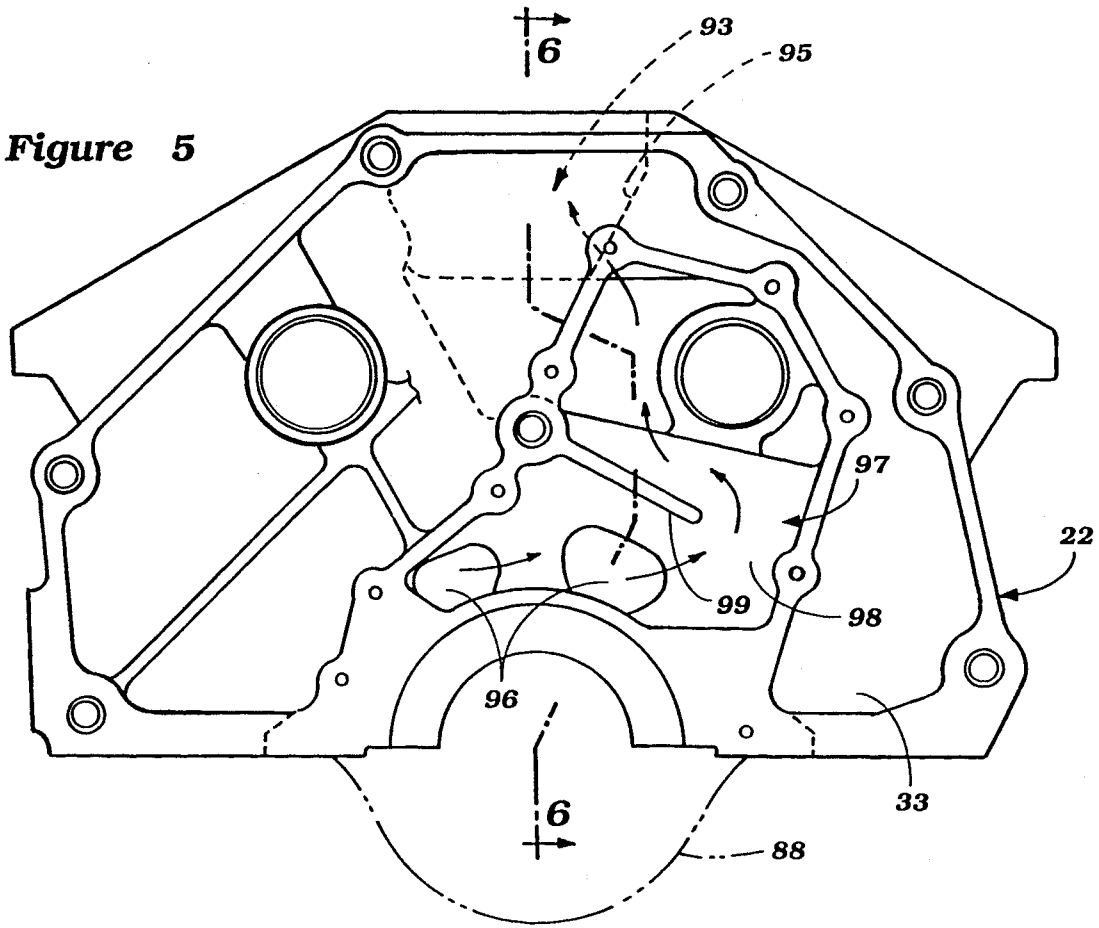
FIG. 5 is a view showing the rear face of the cylinder block with other components removed and is taken generally along the line 5—5 of FIG. 1.
Figure 6:
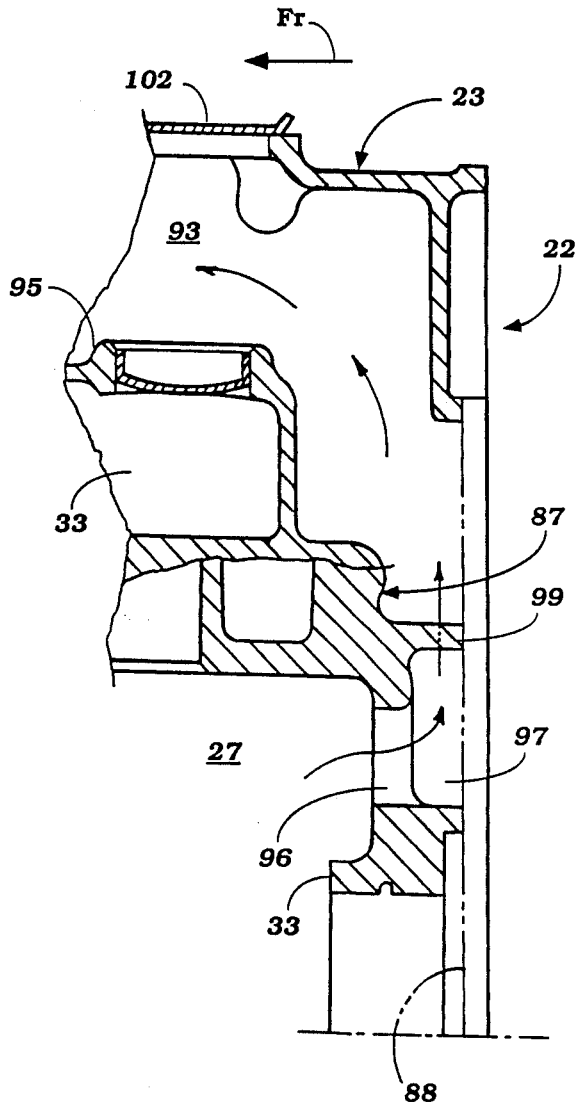
FIG. 6 is a partial cross-sectional view taken along the line 6—6 of FIG. 5.
Figure 7:
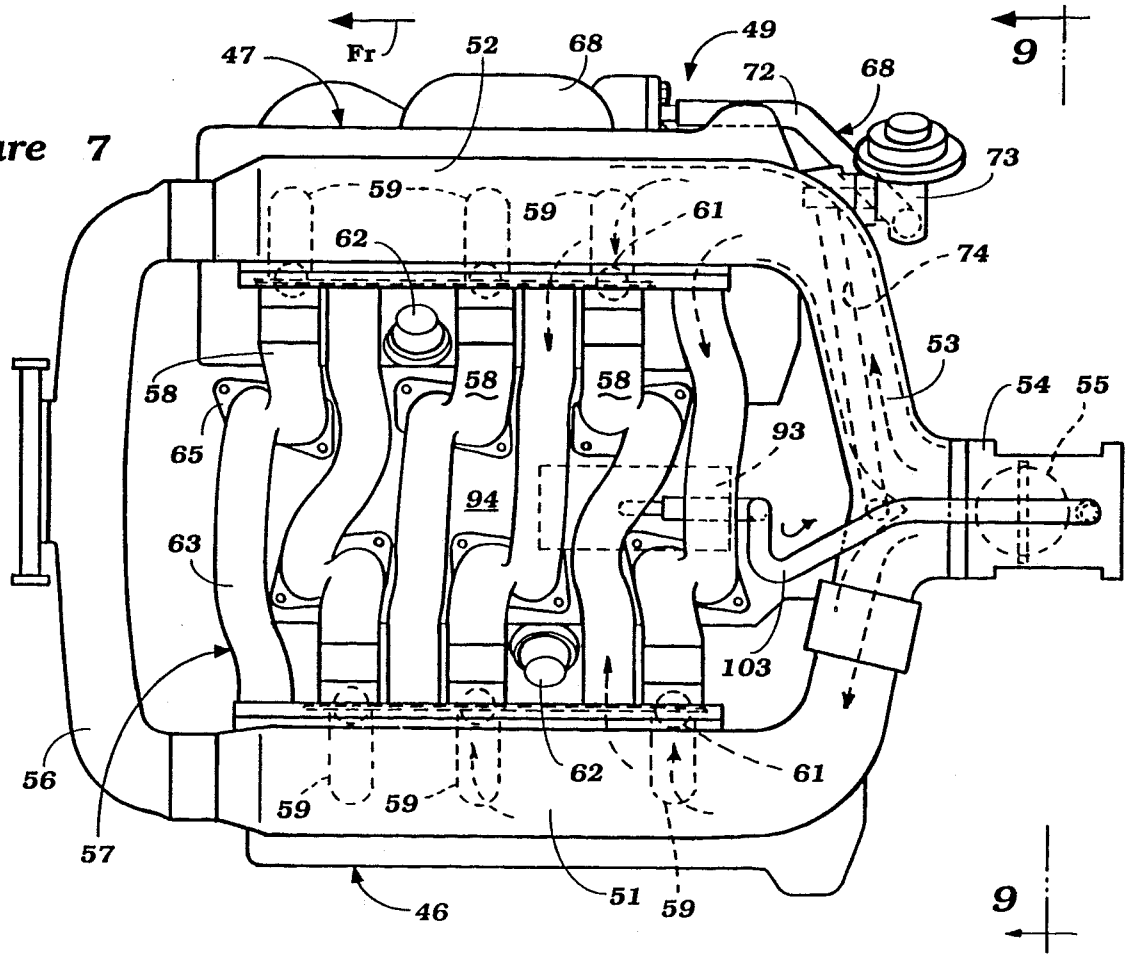
FIG. 7 is a top plan view of the engine.
Figure 8:
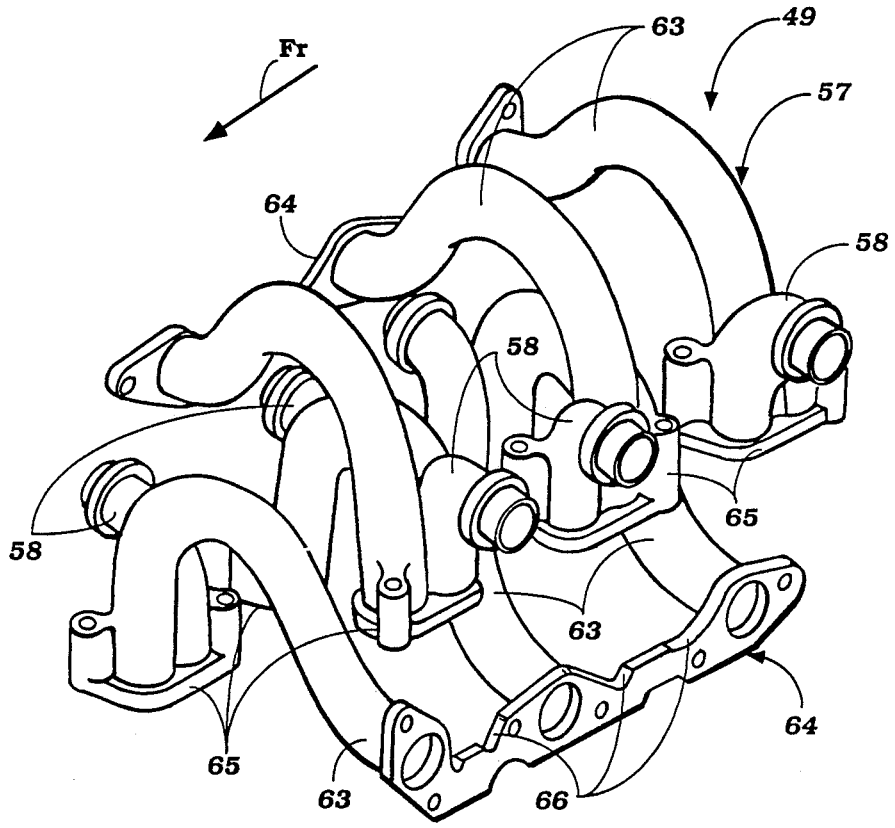
FIG. 8 is a perspective view showing the intake manifold system of the engine.
Figure 9:
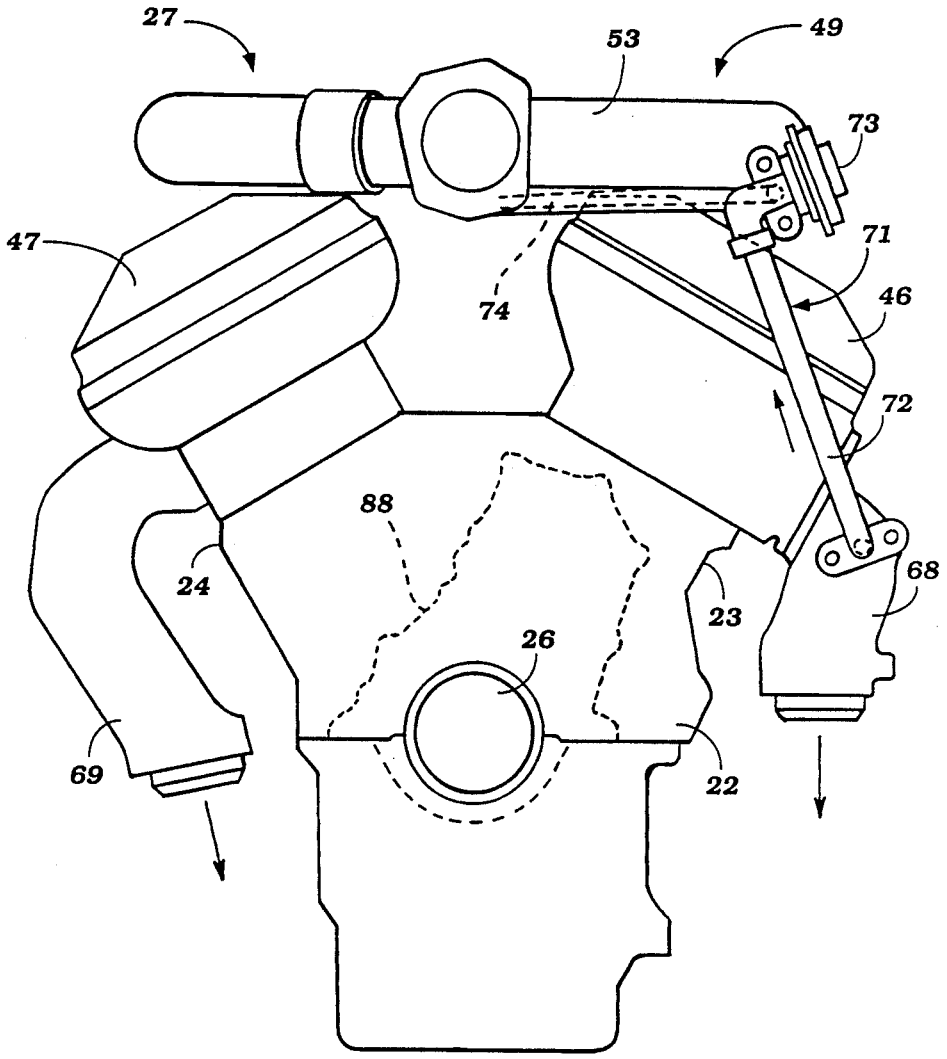
FIG. 9 is an rear end elevational view taken in the direction of the line 9—9 of FIG. 7.
Figure 10:
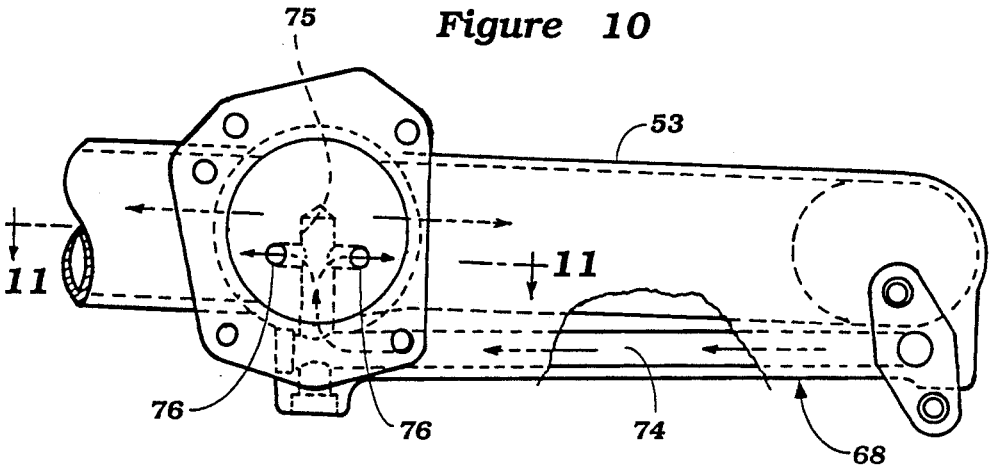
FIG. 10 is a further enlarged front elevational view of a portion of the induction system, with a portion broken away to more clearly show the construction.
Figure 11:
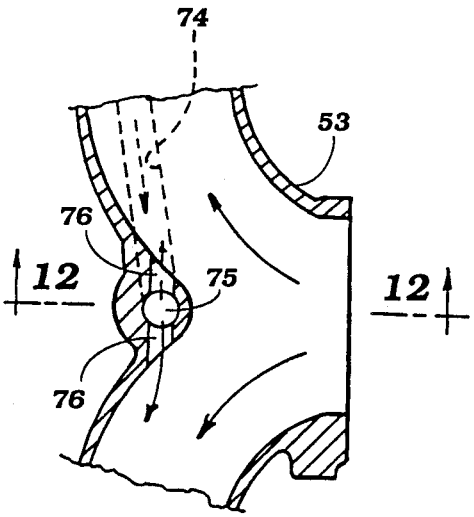
FIG. 11 is a cross-sectional view taken along the line 11—11 of FIG. 10.
Figure 12:
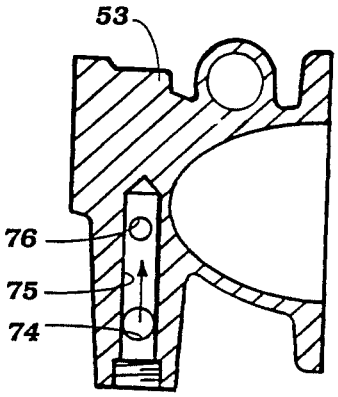
FIG. 12 is a cross-sectional view taken along the line 12—12 of FIG. 11.

As may be best seen in FIG. 3, the cylinder bores 25 of the banks 23 and 24 are staggered with respect to each other so that the connecting rods (not shown) associated with the pistons (also not shown) of the individual cylinder bores 25 may be journaled on the same throws of a crankshaft, indicated generally by the reference numeral 26. This staggering concept is well known in V type engines and, for that reason, further description of it is not believed to be necessary.

The crankshaft 26 is rotatably journaled within a crankcase chamber 27 that is formed beneath the cylinder block 22 and in part by a skirt portion 28 of the cylinder block 22. The crankcase chamber 27 is further closed by means of an oil pan 29 that is affixed to the underside of the cylinder block skirt 28 in a known manner.

The crankshaft 26 is journaled for rotation by means of a plurality of spaced main bearings 31. In the illustrated embodiment, there are provided four main bearings 31. These main bearings 31 are held between front and rear walls 32 and 33 and intermediate webs 34 and 35 formed in the crankcase portion of the cylinder block 22. Front and rear main bearing caps 36 and 37 are connected to the cylinder block front and rear walls 32 and 33 and intermediate main bearing caps 38 and 39 are affixed to the webs 34 and 35. The fasteners for the main bearing caps appear at 41 in FIG. 4.

The main bearing caps 36, 37, 38 and 39 are all connected to each other by means of a rigidifying member 42 that is affixed to the respective bearing caps by threaded fasteners 43 to provide more structural rigidity for the cylinder block 22 and engine assembly 21. An oil baffle 44 is affixed to the member 42 by further threaded fasteners 45 so as to control the oil within the crankcase chamber 27.

Affixed to the cylinder banks 23 and 24 are respective cylinder heads 46 and 47. The cylinder heads 46 and 47 define with the cylinder bores 25 and the pistons the combustion chambers. There are provided intake valves and exhaust valves in the cylinder heads 46 and 47 and respective ports that serve the combustion chamber. Since this construction may be considered to be conventional, it has not been illustrated.

However, it should be noted that, in the illustrated embodiment, the engine 21 is of the four valve per cylinder type and includes two intake valves for each cylinder and two exhaust valves for each cylinder. The intake valves each are served by respective pairs of intake ports that open through a horizontally disposed wall of the cylinder head assemblies. One of these ports appears and is identified by the reference numeral 48 in FIG. 2. These intake ports are served by an induction system of the type generally described in U.S. Pat. No. 4,649,876, entitled "Intake Means Of Internal Combustion Engine", issued Mar. 17, 1987. Briefly summarized, the induction system, which is indicated generally by the reference numeral 49, is comprised of a pair of plenum chambers 51 and 52 that extend generally along and above the cylinder head assemblies 46 and 47, respectively. At one end of the engine (the rear end in the illustrated embodiment) the plenum chambers 51 and 52 are served by a common, generally Y shaped inlet passageway 53 that has a throttle body 54 affixed to its inlet end and in which a flow controlling throttle valve 55 is positioned. Air is delivered to the throttle body 54 from an air cleaner assembly (not shown) in a suitable manner.

At the end of the engine opposite to that at which the throttle body 54 is positioned, the plenum chambers 51 and 52 are further connected by means of a flow transmitting passageway 56 that improves the volumetric efficiency of the engine as described in U.S. Pat. No. 4,766,853, entitled "Intake Passage For Multi Cylinder Engine", issued Aug. 30, 1988. An intake manifold assembly, indicated generally by the reference numeral 57, is provided for delivering an intake charge from the plenum chambers 51 and 52 to the intake ports of the cylinder heads 46 and 47. The intake manifold 57 includes generally a first series of short, high speed runners 58 that extend from each plenum chamber 51 or 52 to one of the intake ports of each of the cylinder heads 46 and 47 that lie beneath the respective plenum chamber 49 and 51. These short runners 58 are tuned so as to provide good running under high speed conditions. These high speed runners 58 extend from inlet trumpets 59 that extend into the respective plenum chamber 51 or 52. A throttle valve mechanism, indicated generally by the reference numeral 61, and which is comprised of individual throttle valve assemblies positioned in the inlet ends of each of the runners 58, is controlled by a progressive throttle linkage or, alternatively, by a load responsive diaphragm motor 62 so that the short runners 58 are normally closed under low and medium range speeds with the runners 58 being opened under high speed conditions so as to provide good efficiency under high speed running.

For improved low speed runing, the manifold 57 is provided with a plurality of low speed intake runners 63 each of which extends from an inlet opening formed in a flange 64 of the manifold 57 that cooperates with one of the plenum chambers 51 and 52 to one intake port of each of the cylinders of the remotely positioned bank. It should be noted that the individual runner pairs 63 and 58 that serve the respective cylinders terminate in flange ends 65 that afford a means of attachment to the respective cylinder head 46 or 47 adjacent its intake ports.

Certain of the manifold flanges, such as the flanges 64, may be formed with recess portions 66 so as to afford access to threaded fasteners so as to permit attachment. Also, the throttle valve assembly 61 is provided with flanged portions 67 so as to facilitate attachment to the respective plenum chambers 51 or 52.

It should be noted that the intake and exhaust valves of the engine 21 are operated by overhead mounted camshafts (not shown) that are driven in a suitable manner, for example, the manner as described in U.S. Pat. No. 4,643,143, entitled "Valve Driving Means For V Type Engine Of Vehicle", issued Feb. 17, 1987. Reference may be had to that patent for the manner in which the camshafts may be driven.

In addition to the intake system 49, the engine 21 is also provided with an exhaust system that includes a pair of exhaust manifolds 68 and 69 that are affixed to the cylinder head assemblies 46 and 47, respectively (FIG. 9), and which cooperate with their exhaust ports. The manifolds 68 and 69 cooperate with a further exhaust system (not shown) which may be of any known type.

The engine 21 is also provided with an exhaust gas recirculation system (EGR) indicated generally by the reference numeral 71 that serves to reduce the emission of NOx constituents to the atmosphere This EGR system 71 includes a conduit 72 that extends from a port in one of the manifolds (in this instance the manifold 68) to an EGR valve 73 that is operated in accordance with any desired type of strategy. The EGR valve 73 operates when opened to recirculate exhaust gases back into the induction system through an internal passageway 74 that is formed in the inlet section 53 of the induction system 49. As may be best seen in FIGS. 10 through 12, the manifold passageway 74 terminates at a cross-drilled passageway 75 that is also cross-drilled as at 76 so as to provide a pair of outlet ports that open into each of the branches of the inlet section 53 so as to equally distribute the exhaust gases being recirculated to the plenum chambers 51 and 52.

Figure 2:
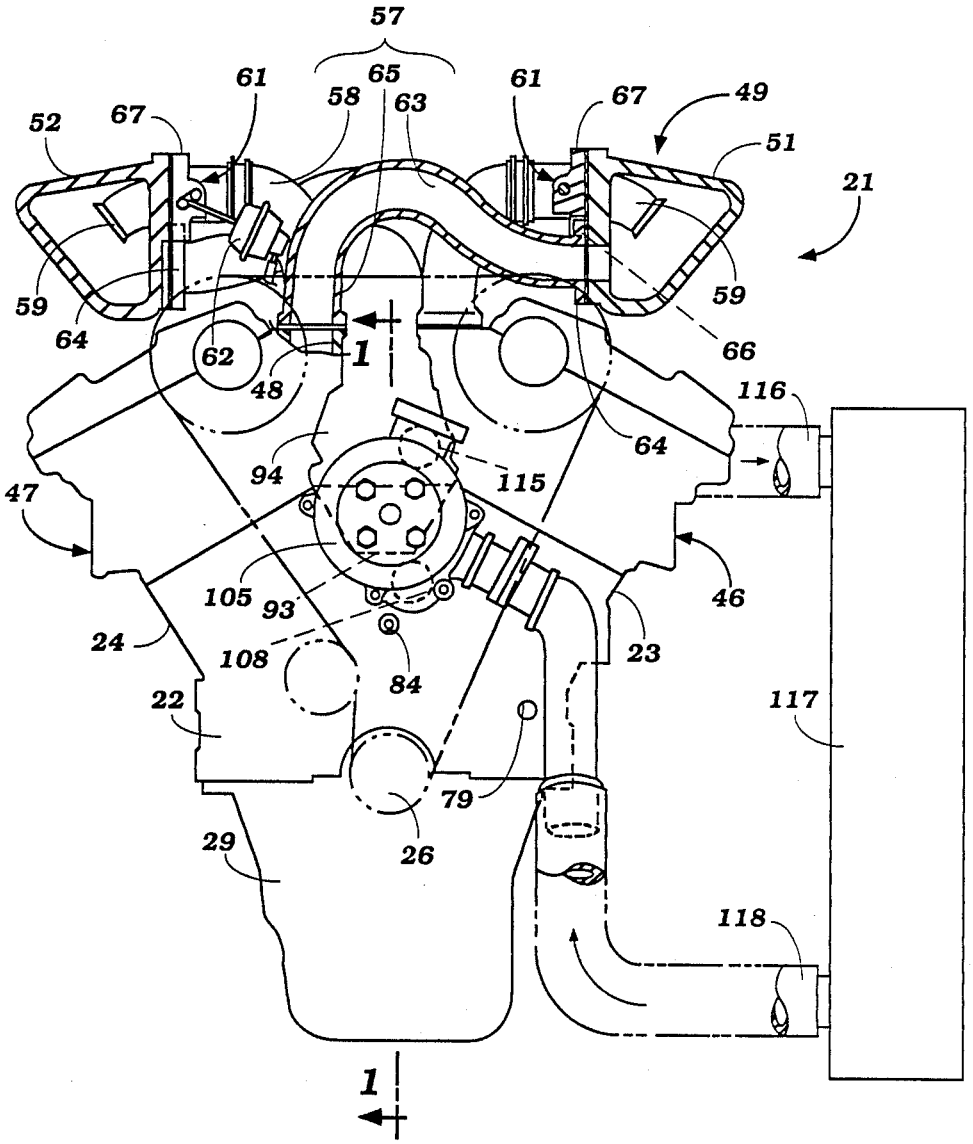
FIG. 2 is a front elevational view of the engine looking generally in the direction of the arrow 2 in FIG. 1, with portions broken away.

The engine 21 is also provided with a lubricating system which is shown partially in FIGS. 1 through 3 of the drawings and which includes a lubricant pump, indicated generally by the reference numeral 77 and shown only schematically. The lubricant pump 77 includes an impeller or pumping element 78 that is driven off the forward end of the crankshaft 26 in a known manner. The lubricant pump 77 discharges its output through a pressure passage 79 that extends through one side of the cylinder block 22 and which communicates with an inlet port formed in an oil filter mount 81. An oil filter 82 is carried on the mount 81 and filters the oil delivered from the passage 79. If desired, the filter mount 81 may also be provided with a cooling jacket so as to cool the circulated lubricant.

The oil is discharged from the oil filter 82 through the mount 81 into a cylinder block passage 83 that intersects a main oil gallery 84 that extends along the length of the cylinder block 22 and specifically at the base of the valley of the V, for a reason which will be described. A plurality of delivery passages 85 which are formed in the cylinder block end walls 32 and 33 and specifically web portions 86 and 87 thereof and through the webs 34 and 35 serve to lubricate the main bearings 31. Lubricant is also delivered to various other components of the engine to be lubricated in any suitable manner.

A blanking plate 88 is appropriately affixed to the rear face of the cylinder block 22 and is formed with a cylindrical recess 89 in which an oil seal 91 is supported. The oil seal 91 engages a surface 92 formed on the crankshaft 26 so as to provide a rear main seal.

A system is provided for circulating ventilating air through the crankcase 27 of the engine, this air being derived primarily from blow by air and for returning it to the atmosphere after passing through the combustion chambers of the engine. This crankcase ventilating system includes a ventilating chamber 93 that extends in the valley 94 between the cylinder banks 23 and 24. In this embodiment, the chamber 93 is formed at the rear end of the engine and specifically of the cylinder block 23 and is defined by an upstanding wall 95 of the cylinder block 23. The crankcase ventilating gases from the crankcase 27 are transferred to the chamber 93 by means of a plurality of inlet openings 96 formed in the web 87 and which communicate with a passageway 97 formed by a recessed area 98 of the rear wall of the cylinder block 23 which is closed by the blanking plate 88. It should be noted that the passageway 97 is offset to the side of the cylinder bank 24 in the area formed by the stagger between the cylinder banks so as to permit the flow of crankcase ventilating gases in this area without elongation of the cylinder block 22 or engine 21.

The rear face of the cylinder block 22 is formed with an outwardly extending rib 99 (FIG. 5) that forms a circuitous path to the passageway 97 so as to assist in the separation of lubricant from the crankcase ventilating gases. In addition, there is provided a separator unit 101 that is fixed to a plate 102 that spans the upper side of the cavity 93 and forms a closure for it. A flexible conduit 102 conveys the crankcase ventilating gases from the chamber 93 to the induction system for reintroduction into the engine and to burn any hydrocarbons contained within the crankcase ventilating gases before their admission to the atmosphere. The conduit 102 extends to an inlet opening that is formed in the throttle body 54 upstream of the throttle valve 55 but downstream of the air inlet device (not shown) so as to insure against any admission of these gases directly to the atmosphere.

The lubricating system for the engine 21, in addition to the passages already described, also includes a mechanism for lubricating the valve train contained within the cylinder heads 46 and 47. Lubricant is returned to the crankcase 29 from the cylinder head assemblies through drain passages 104 (FIG. 3) formed in the cylinder block 22.

The engine 21 is also provided with a liquid cooling system that includes a water pump 105 that is driven at the forward end of the engine by a belt (not shown) that drives a pulley 106 from the crankshaft 26 in a known manner. An impeller 107 is affixed to the shaft driven by the pulley 106 and discharges water into a main cooling gallery 108 that extends longitudinally along the length of the engine 21 at the base of the valley 94 and in proximity to the main oil gallery 84 and also underlying the cavity 93 of the crankcase ventilating system. Because of the interposition of the coolant gallery 104 between the crankcase chamber 27 and the crankcase ventilating chamber 93, the crankcase gases will be cooled and any oil contained in them will tend to condense or form into larger particles that will be easily separated by the separator 101 and returned to the crankcase 29 so as to reduce the amount of oil consumption and also the discharge of oil into the induction system.

A plurality of passages 109 interconnect the main coolant gallery 108 with individual cooling jackets 111 formed around the individual cylinders of the cylinder banks 23 and 24.

Passageways 112 formed in the upper decks of the cylinder banks 23 and 24 deliver coolant from the cylinder block to the individual cylinder heads 46 and 47 for circulation through the cooling jackets thereof.

The coolant which has circulated through the cylinder block cooling jackets described and the cylinder head cooling jackets is then returned to a combined water manifold and thermostat housing 113 that is positioned at the rear end of the engine or the end opposite to that of the water pump 105. A thermostatic valve 114 is contained within the housing 113 and when the engine is below its normal operating temperature, the coolant is returned directly to the water pump 105 through a bypass conduit 115 that extends through the valley 94 of the engine. On the other hand, when the engine is at its normal operating temperature, the thermostatic valve 114 opens and coolant is delivered from the thermostat housing 113 through a This coolant then flows through the core of the radiator 117 and is returned to the water pump through a further conduit 118.

A knock sensor 119 may be affixed to the upper end of the wall 95 for controlling the ignition in a known manner to prevent knocking. Alternatively, the knock sensor 119 may be mounted on an upper deck 121 of the cylinder block assembly as shown in phantom in FIG. 1.

Figure 13:
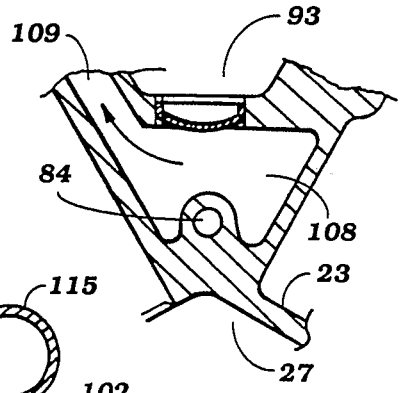
FIG. 13 is a partial cross-sectional view, in part similar to FIG. 4, showing a further embodiment of the invention.

In the embodiment thus far described, it should be noted that the main water gallery 108 for the engine at least partially encircles the main oil gallery 84 so as to provide some cooling for the lubricant. However, it is also possible to extend the oil gallery 84 further up into the water cooling gallery 108 as shown in FIG. 13 to provide additional cooling.

Figure 14:
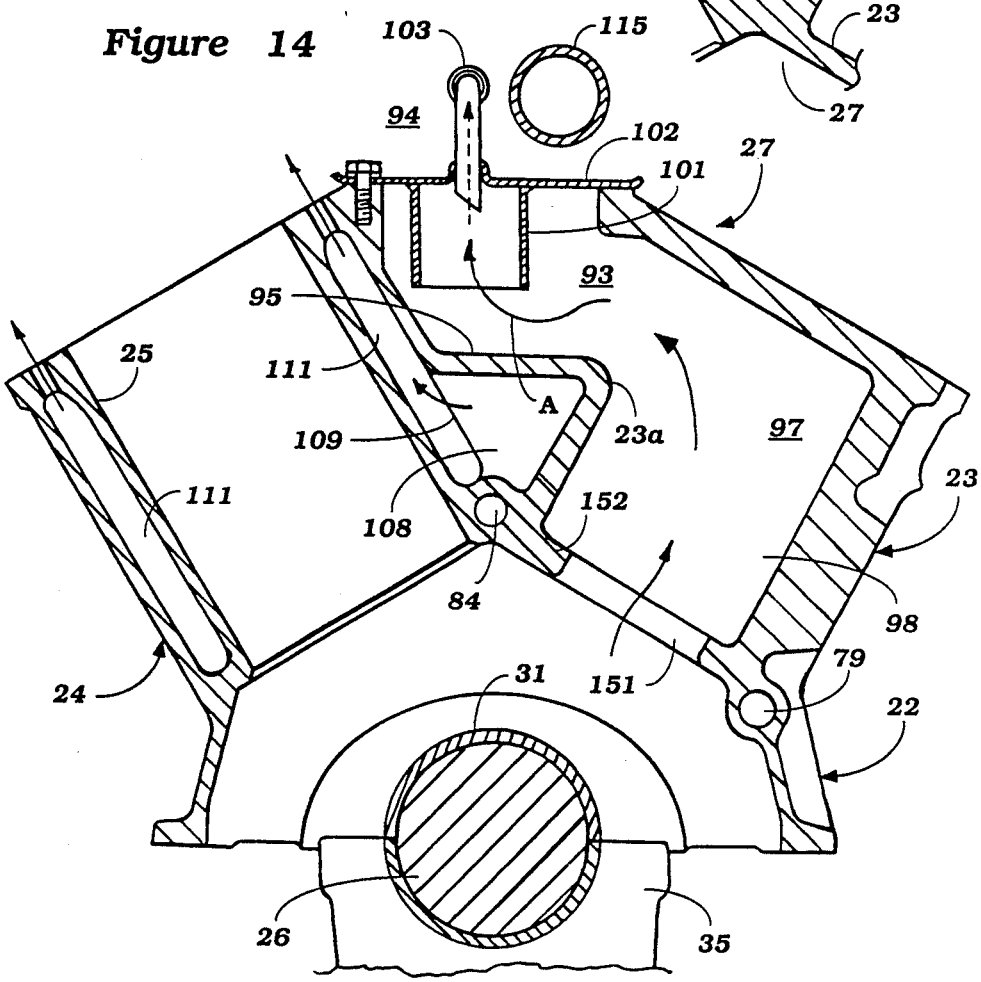
FIG. 14 is a cross-sectional view taken along the line 14—14 of FIG. 3 but shows a still further embodiment of the invention.

In the embodiment of FIGS. 1 through 12, the crankcase ventilating gases were delivered to the chamber 93 through the openings 96 in the rear wall 98 of the cylinder block. However, it is also possible to deliver the gases to the chamber 93 through an opening 151 formed in a lower deck 152 of the cylinder bank 23 at the front of the engine in the area of the stagger of the cylinder banks so as to permit the compact engine size. Such an embodiment is shown in FIG. 14 which is a cross-sectional view taken along the line 14—14 of FIG. 13 but shows this modification. In this embodiment, the chamber 93 will be positioned at the front of the engine rather than at the rear. It is to be understood that the chamber 93 may also extend the full length of the valley 94, if desired.

In the two embodiments described, the crankcase ventilating gases are delivered to the crankcase ventilating chamber or passage 93 through openings in the cylinder block. It is to be understood, however, that if the engine utilizes a chain drive for the camshafts, the crankcase ventilating gases may be discharged into the chain case and then delivered to the chamber 93.

It should be readily apparent from the foregoing description that the embodiments of the invention are particularly useful in providing a very effective crankcase ventilating system wherein the crankcase ventilating gases will not be unduly heated and hence the separation of any lubricant that may be contained within the crankcase ventilating gases is facilitated. Although a number of embodiments of the invention have been illustrated and described, various changes and modifications may be made without departing from the spirit and scope of the invention, as defined by the appended claims.

We claim:

1. A crankcase ventilating system for an internal combustion engine comprising a cylinder block having a plurality of aligned cylinders, a crankcase positioned beneath said cylinder block, a crankcase ventilating chamber formed at least in part by said cylinder block and extending along at least a portion of its length, a crankcase ventilating inlet communicating said crankcase ventilating chamber with said crankcase for receiving ventilating gases therefrom, a crankcase ventilating outlet for discharging crankcase ventilating gases from said crankcase ventilating chamber, and a cooling jacket formed in said cylinder block and positioned to extend adjacent said crankcase ventilating chamber and separating said crankcase ventilating chamber from said crankcase for cooling the crankcase ventilating gases to recondense vaporized lubricant from said crankcase.

2. A crankcase ventilating system as set forth in claim 1 wherein the engine is of the V type and has angularly disposed cylinder banks each containing at least one cylinder bore and wherein the crankcase ventilating chamber is formed between the banks of cylinders in the valley of the cylinder block.

3. A crankcase ventilating system as set forth in claim 2 wherein the crankcase ventilating inlet is formed at one end of the engine.

4. A crankcase ventilating system as set forth in claim 3 wherein the cylinder bores of the cylinder blocks are staggered and the inlet is positioned at the area of the stagger of the cylinder banks.

5. A crankcase ventilating system as set forth in claim 4 wherein the inlet is at the front end of the engine.

6. A crankcase ventilating system as set forth in claim 4 wherein the inlet is at the rear end of the engine.

7. A crankcase ventilating system as set forth in claim 3 wherein the engine is provided with a chain case at one end thereof and the crankcase ventilating gases pass to the chamber through the chain case.

8. A crankcase ventilating system as set forth in claim 1 wherein the cooling jacket portion forms a water inlet to the cylinder block and communicates with individual cooling jackets surrounding the cylinder bores.

9. A crankcase ventilating system as set forth in claim 8 further including a main oil gallery for the engine extending adjacent the cooling jacket portion.

10. A crankcase ventilating system as set forth in claim 9 wherein the main oil gallery is interposed between the cooling jacket portion and the crankcase and is at least partially encircled by the cooling jacket portion for cooling of the lubricant.

11. A crankcase ventilating system as set forth in claim 8 wherein the engine is of the V type and has angularly disposed cylinder banks each containing at least one cylinder bore and wherein the crankcase ventilating chamber is formed between the banks of cylinders in the valley of the cylinder block.

12. A crankcase ventilating system as set forth in claim 11 wherein the crankcase ventilating inlet is formed at one end of the engine.

13. A crankcase ventilating system as set forth in claim 12 wherein the cylinder bores of the cylinder blocks are staggered and the inlet is positioned at the area of the stagger of the cylinder banks.

14. A crankcase ventilating system as set forth in claim 13 wherein the inlet is at the front end of the engine.

15. A crankcase ventilating system as set forth in claim 13 wherein the inlet is at the rear end of the engine.

16. A crankcase ventilating system as set forth in claim 12 wherein the engine is provided with a chain case at one end thereof and the crankcase ventilating gases pass to the chamber through the chain case.

17. A crankcase ventilating system as set forth in claim 1 wherein the crankcase ventilating chamber is formed in the upper surface of the cylinder block and is closed by a cover plate containing an oil separator.

* * * * *